United States Patent [19]

Card

[11] 4,003,321

[45] Jan. 18, 1977

[54] CUT PILE APPARATUS FOR STAGGERED NEEDLE TUFTING MACHINE

[75] Inventor: Roy T. Card, Chattanooga, Tenn.

[73] Assignee: Card & Co., Inc., Chattanooga, Tenn.

[22] Filed: June 3, 1974

[21] Appl. No.: 475,625

[52] U.S. Cl. ..... 112/79 R

[51] Int. Cl.[2] ..... D05C 15/12

[58] Field of Search ..... 112/79 R, 79 A, 266, 112/199, 165

[56] References Cited

UNITED STATES PATENTS

| | | | |
|---|---|---|---|
| 3,019,748 | 2/1962 | Card | 112/79 A |
| 3,492,956 | 2/1970 | Webb | 112/79 R |
| 3,850,120 | 11/1974 | Jackson | 112/79 R |
| 3,913,505 | 10/1975 | Crumbliss et al. | 112/79 R |

*Primary Examiner*—Werner H. Schroeder
*Assistant Examiner*—Peter Nerbun
*Attorney, Agent, or Firm*—Harrington A. Lackey

[57] ABSTRACT

A multiple needle tufting machine in which the needles are arranged in at least two transverse rows and including first and second sets of cut pile hooks and knives cooperating to form cut pile. Both sets of cut pile hooks may be mounted in the same hook bar so that the throats of the hooks and the knives are substantially transversely aligned. The bills of the second set of hooks are longer than the bills of the first set of hooks, preferably in an amount equal to the longitudinal spacing between the transverse rows of needles, for cooperation with the needles in the respective transverse rows.

6 Claims, 3 Drawing Figures

Fig. 3
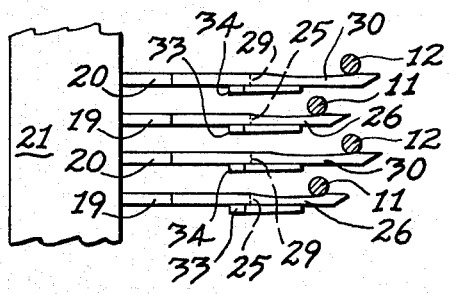
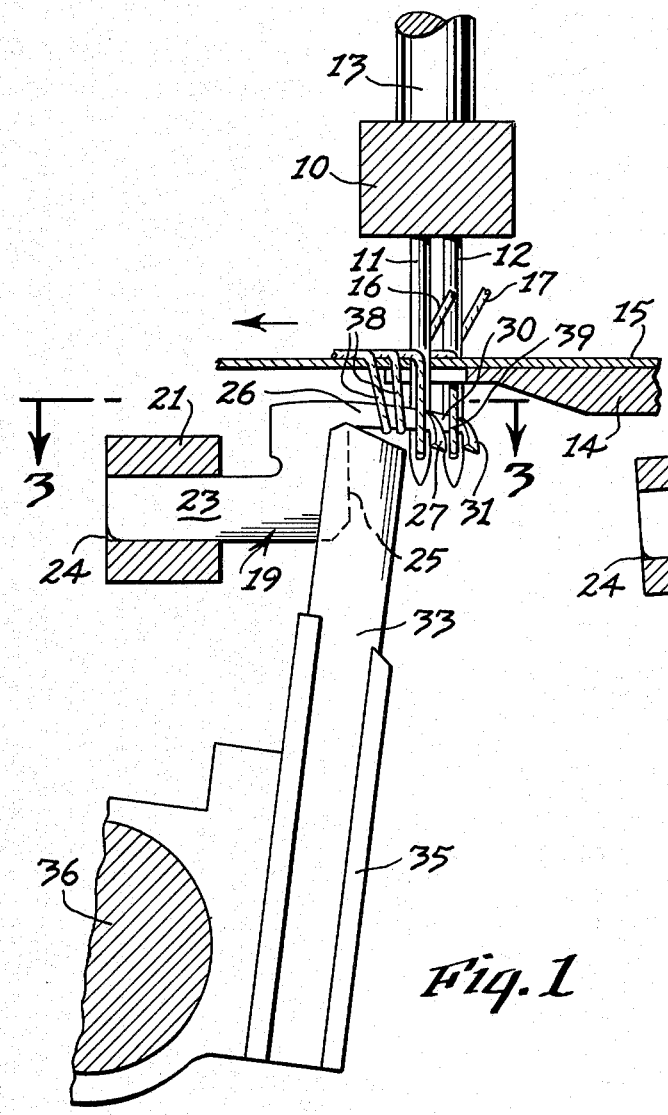
Fig. 1
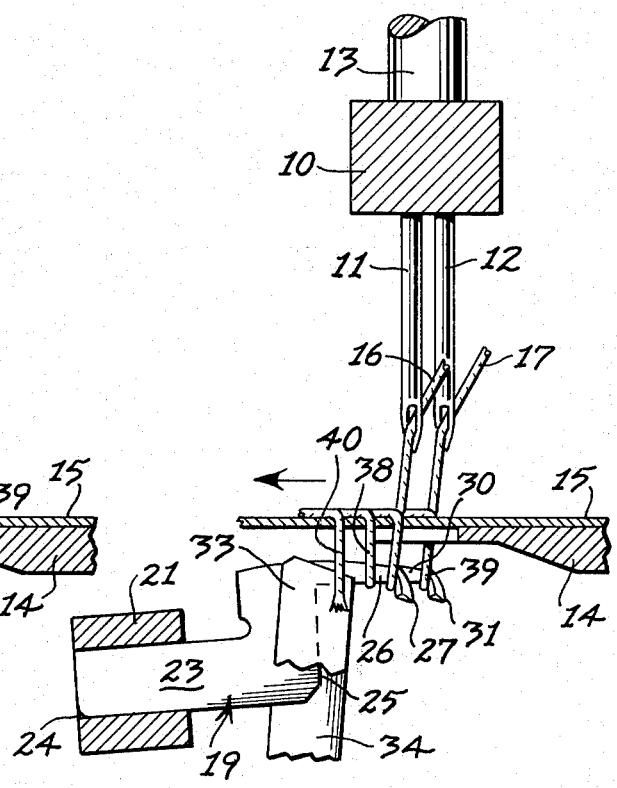
Fig. 2

CUT PILE APPARATUS FOR STAGGERED NEEDLE TUFTING MACHINE

BACKGROUND OF THE INVENTION

This invention relates to a tufting machine, and more particularly to a cut pile apparatus for a staggered needle tufting machine.

Heretofore in multiple needle tufting machines having plural transverse rows of needles, or alternately staggered needles, conventional knives and conventional cut pile hooks have been used. However, because the knives were of identical construction and the cut pile hooks were of identical construction, both the hooks and the knives had to be mounted in the same staggered arrangement as the needles so that each cut pile hook could cooperatively engage its corresponding needle in its staggered position for catching and holding each loop of yarn to be cut by a corresponding knife. However, considerable additional work is required for setting the conventional cut pile hooks in staggered slots in a reciprocal hook bar and also for arranging the knives in staggered relationship for uniform reciprocal movement on a knife bar.

SUMMARY OF THE INVENTION

It is therefore an object of this invention to provide a more simplified cut pile hook construction for cooperation with staggered needles in a tufting machine.

A uniform first set of cut pile hooks are formed with a bill of a predetermined length, so that each hook in the first set can cooperate with corresponding needles in one transverse row of needles. A second set of cut pile hooks are formed practically identical in construction to the first set of hooks, except that the bills of the second set are either longer or shorter than the bills of the first set by an amount equal to the longitudinal spacing between the first transverse row of needles and a second transverse row of needles. Thus, the shanks of all of the first and second sets of hooks can be inserted in slots of a conventional hook bar so that the throats of the hooks are all substantially transversely aligned, yet the bills of the respective hooks will project different lengths corresponding to the respective distances between the needles and the hook throats.

Moreover, the conventional knives may be mounted in a conventional manner upon a knife bar so that all of the knives are also substantially transversely aligned for cooperation with their corresponding hooks, whether in a first or second set.

BRIEF DESCRIPTION OF THE DRAWINGS

FIG. 1 is a fragmentary sectional elevation of a portion of a tufting machine incorporating this invention, disclosing the cut pile apparatus in a non-cutting position.

FIG. 2 is a view similar to FIG. 1 disclosing the cut pile apparatus in a cutting position; and FIG. 3 is a fragmentary section taken along the line 3—3 of FIG. 1.

DESCRIPTION OF THE PREFERRED EMBODIMENTS

Referring now to the drawings in more detail, FIGS. 1 and 2 disclose a typical needle bar 10 supporting a plurality of needles 11 in a first or rear transverse row and a plurality of needles 12 in a second or front transverse row spaced longitudinally forward of the first row of needles 11. The needle bar 10 is adapted to reciprocably move between its lower position disclosed in FIG. 1 and its upper position disclosed in FIG. 2 by a push rod 13 driven by conventional means, not shown.

As best disclosed in FIG. 3, the needles 11 in the first row and the needles 12 in the second row are alternately staggered transversely of the tufting machine.

Supported upon a needle plate 14 for movement longitudinally from front to rear in a feeding direction through the tufting machine is a base fabric 15. Each needle 11 carries a yarn 16 and each needle 12 carries a yarn 17 through the base fabric 15 upon each stroke of the needle bar 10.

The cut pile apparatus made in accordance with this invention includes a plurality of first cut pile hooks 19 and a plurality of second cut pile hooks 20, all of which cut pile hooks 19 and 20 are fixedly supported upon a hook bar 21 for reciprocal movement, by conventional means, not shown.

Each cut pile hook 19 of the first set includes an elongated shank 23 adapted to fit in a corresponding slot 24 in the hook bar 21. The first cut pile hook 19 also includes a vertically disposed throat 25 from which projects in the direction opposite to the fabric feeding direction, indicated by the arrow in FIGS. 1 and 2, a bill 26 of predetermined length. The point 27 of the bill 26 is barbed or downturned, in a conventional manner for cut pile hooks.

Each cut pile hook 20 of the second set is made substantially identical to the construction of a first cut pile hook 19 having a shank, not shown, identical to the shank 23, and a throat 29 identical to the throat 25 of each first cut pile hook 19. However, the bill 30 of each cut pile hook 20 of the second set is longer than the bill 26 of a first cut pile hook 19. The difference in the lengths of the bills 30 and 26 is preferably equal to the longitudinal spacing between the transverse rows of needles 11 and 12. Each bill 30 may be provided with the same downturned or barbed end 31, if desired.

Thus, by inserting the shanks of alternating first and second cut pile hooks 19 and 20 in the uniformly spaced and sized slots 24 in the same hook bar 21, the throats 25 and 29 of all the cut pile hooks 19 and 20 will be transversely aligned, as indicated in FIG. 3. However, the bills 26 and 30, being of alternately different lengths, will project a corresponding amount across each alternately staggered needle 11 and 12, as best disclosed in FIG. 3.

Identical tufting knives 33 and 34 are mounted in transverse alignment in corresponding knife holders 35 fixed to the reciprocal knife shaft 36, adapted to be rocked or reciprocated in a conventional manner. Each knife 33 is adapted to cooperate with a corresponding cut pile hook 19 in order to cut loops 38 formed upon the bills 26, in a conventional manner for forming cut pile. In the same manner, each knife 34 is adapted to cooperate with a bill 30 of the second cut pile hooks 20 for cutting loops 39 formed on the bills 30 by cooperation with the needles 12 in order to form corresponding cut pile tufts, such as 40 formed on cut pile hook 19 (FIG. 2).

It will also be understood that cut pile hooks 19 and 20 made in accordance with this invention do not have to be alternately staggered, but can be spaced apart in different arrangements corresponding with the arrangement of the needles in the transverse rows of the needle bar 10. For example, the needles 11 could be arranged in pairs in alternately staggered pairs of needles 12. As a matter of fact, there are infinite numbers of arrangements of the needles 11 and 12 in each of the two transverse rows. Whatever the arrangement of the needles 11 and 12, the cut pile hooks 19 and 20 can be re-arranged accordingly so that there is a first cut pile hook 19 cooperating with each needle 11 and a second cut pile hook 20 cooperating with each needle 12.

Thus, a cut pile apparatus has been produced in which only the bills of the cut pile hooks have been varied in length. Such construction permits the shanks and throats of the cut pile hooks in both sets, as well as the knives cooperating with all the hooks, to be maintained in substantially transverse alignment and permits all the hooks 19 and 20 to be mounted in the same conventional hook bar 21 and the knives 33 and 34 to be mounted in the knife holders 35 without modification of these parts. Furthermore, because of this construction of the cut pile apparatus, maintenance and installation times are considerably reduced.

What is claimed is:

1. In a tufting machine having means for supporting a base fabric for longitudinal movement in a feeding direction through said machine, and a plurality of reciprocal needles for introducing yarns through the base fabric to form loops, said needles being spaced apart in at least first and second longitudinally spaced rows extending transversely of the feeding direction, a cut pile appratus comprising:

a. a first cut pile hook for each needle in said first transverse row, said first cut pile hook having a throat and a bill projecting from said throat a predetermined length, b. a second cut pile hook for each needle in said second transverse row, said second cut pile hook having a throat and a bill projecting from the throat of said second cut pile hook a length different from the length of the bill of said first cut pile hook by an amount substantially equal to the longitudinal spacing between said first and second transverse rows of needles, c. reciprocal hook bar means extending transversely of said feeding direction adjacent said fabric supporting means, d. means fixing each cut pile hook to said hook bar means so that said bills point in the direction opposite said feeding direction, the throats of all said first and second hooks are in substantial transverse alignment, and each first cut pile hook cooperates with a corresponding needle in said first transverse row to form a first cut pile loop and each second cut pile hook cooperates with a corresponding needle in said second transverse row to form a second cut pile loop, e. a knife for each of said first and second cut pile hooks, and f. knife supporting means supporting all of said knives in substantial transverse alignment parallel to the alignment of the throats of said bills, for reciprocable cooperative movement with a corresponding cut pile hook to form first and second transverse rows of cut pile tufts.

2. The invention according to claim 1 in which all said needles have a uniform gauge, and all said cut pile hooks are uniformly spaced on the same gauge as said needles.

3. The invention according to claim 2 in which the needles in said first and second transverse rows are alternately staggered transversely of the feeding direction, and said first and second cut pile hooks alternate transversely of said feeding direction, so that the bill on each cut pile hook crosses its corresponding needle by a substantially uniform amount.

4. The invention according to claim 1 in which each of said first and second cut pile hooks comprises a uniform shank, a plurality of uniform slots in said hook bar means, each slot adapted to receive a shank of a corresponding cut pile hook, said slots being transversely aligned and parallel to the alignment of the throats of said hooks.

5. In a tufting machine for making cut-pile fabric, means for supporting a backing fabric fed from front to rear of the machine, a needle bar means carrying front and rear laterally extending spaced rows of yarn carrying needles disposed on one side of the backing fabric, the needles in the rear row being staggered relatively to the front row, means for reciprocating the needles to penetrate and insert loops of yarn through the backing fabric, a looper associated with each needle disposed on the opposite side of the backing fabric from said needles, each looper including a body portion and a loop penetrating bill angularly extending from said body portion and defining a throat therebetween, the bills of the loopers associated with the front row of needles being longer than the bills of the other loopers by substantially the spacing between the front and rear row, means for supporting the body portion of said loopers with all the throats substantially aligned laterally, means for actuating said loopers so that said bills enter respective loops of yarn presented by said needles to seize and hold the loops when the needles are withdrawn, a knife disposed on one side of each hook and having a cutting edge for cooperating with the respective blade adjacent the throat for severing loops thereon to form cut-pile, means for supporting said knives substantially aligned laterally, and means for actuating said knives in timed relation to the actuation of said loopers for movement in a path wherein said cutting edges are moved into cutting engagement with the respective blade.

6. A looper assembly for a tufting machine comprising a looper bar, a plurality of loopers, each looper including a body portion and a loop penetrating and seizing bill angularly extending from said body portion and defining a throat therebetween, means for mounting said body portions in said looper bar in a row with all the throats substantially aligned, and the bills on alternate loopers being longer than the bills of the adjacent loopers.

* * * * *